US007194770B1

(12) United States Patent
Fecenko

(10) Patent No.: US 7,194,770 B1
(45) Date of Patent: Mar. 27, 2007

(54) WORK PANTS WITH BUILT-IN KNEE PADS

(76) Inventor: Nicholas D. Fecenko, 17 Brewer Ave., Hilltop, NJ (US) 08012

( * ) Notice: Subject to any disclaimer, the term of this patent is extended or adjusted under 35 U.S.C. 154(b) by 0 days.

(21) Appl. No.: 11/315,661

(22) Filed: Dec. 22, 2005

(51) Int. Cl.
*A41D 1/06* (2006.01)

(52) U.S. Cl. ..... 2/227

(58) Field of Classification Search ..... 2/23, 2/24, 16, 267, 455, 79, 227, 908, 911; 602/23, 602/26, 62
See application file for complete search history.

(56) References Cited

U.S. PATENT DOCUMENTS 2,135,213 A * 11/1938 Luery et al. ..... 2/23
2,561,872 A * 7/1951 Krinick ..... 2/24
3,346,877 A 10/1967 Zirves
4,561,123 A 12/1985 Hull
4,772,071 A 9/1988 Richards
5,539,927 A 7/1996 Holubec
5,611,081 A 3/1997 Torres
D395,939 S 7/1998 DeFino
5,845,333 A 12/1998 Crampton
5,937,441 A * 8/1999 Raines ..... 2/69
6,421,839 B1 7/2002 Vo et al.
6,704,938 B2 * 3/2004 Crockett ..... 2/23
6,769,134 B1 8/2004 Mendez

* cited by examiner

*Primary Examiner*—Tejash Patel
(74) *Attorney, Agent, or Firm*—Norman E. Lehrer

(57) ABSTRACT

The work pants include a right leg member and a left leg member. Each of the leg members has a lower edge, a knee section extending downwardly from the lower edge of each of the leg members, padded material housed within each of the knee sections, and a plurality of straps where each of the straps has a clip attached thereto so that the straps may be releasably attached to the worker's shoes. The work pants may be in the form of shorts.

3 Claims, 4 Drawing Sheets

WORK PANTS WITH BUILT-IN KNEE PADS

BACKGROUND OF THE INVENTION

The present invention is directed toward work pants and more particularly, toward shorts with built-in knee pads.

Knee pads are frequently worn by people whose occupations require them to kneel for long periods of time and/or on rough surfaces. For example, construction workers, repairmen, gardeners, carpenters, and maintenance workers are quite often kneeling for long periods of time. This causes strain and stress on the person's joints. In order to alleviate this added stress to a person, knee pads are worn. Typically, knee pads are strapped on the person's legs and are very tightly strapped on in order to hold the pads in place as the person moves about. This can become extremely uncomfortable and after a period of time, the straps will need to be readjusted. Also, the straps and pads may be somewhat cumbersome to wear, remove, and transport.

Many solutions have been proposed in order to overcome the problems described above. For example, U.S. Design Pat. No. D395,939 to DeFino discloses a pair of gardening pants that appear to be shorts with knee pads built into them. However, these knee pads do not appear to be stable. That is, the knee pads are built into the pants and are free to move about. Similarly, U.S. Pat. No. 5,611,081 to Torres discloses work pants with knee pads built into the knee area of the pants.

U.S. Pat. No. 4,561,123 to Hull discloses knee pads that are removably attached to the knees of work pants where the pads are attached to the pants via hook and loop fasteners. These knee pads, however, may inadvertently be released from the pants as the worker moves about on his or her knees.

Therefore, a need exists for work pants that include knee pads that are attached to the pants and secured to a worker yet allow for mobility and are not overly constricting.

SUMMARY OF THE INVENTION

The present invention is designed to overcome the deficiencies of the prior art discussed above. It is an object of the present invention to provide work pants in the form of shorts with built-in knee pads.

It is another object of the present invention to knee pads that are attached to the work pants and may be secured to the worker but are not too constricting.

In accordance with the illustrative embodiments demonstrating features and advantages of the present invention, there is provided a pair of work pants worn by a person that includes a right leg member and a left leg member, each of the leg members has a lower edge, a knee section extending downwardly from the lower edge of each of the leg members, padded material housed within each of the knee sections, and means for releasably securing each of the knee sections to the person. The work pants may be in the form of shorts. The securing means may include a plurality of straps where each of the straps has a clip attached to an end of the strap so that the straps may be attached to the worker's shoes.

Other objects, features, and advantages of the invention will be readily apparent from the following detailed description of a preferred embodiment thereof taken in conjunction with the drawings.

BRIEF DESCRIPTION OF THE DRAWINGS

For the purpose of illustrating the invention, there is shown in the accompanying drawings one form that is presently preferred; it being understood that the invention is not intended to be limited to the precise arrangements and instrumentalities shown.

DETAILED DESCRIPTION OF THE PREFERRED EMBODIMENT

Figure 1:
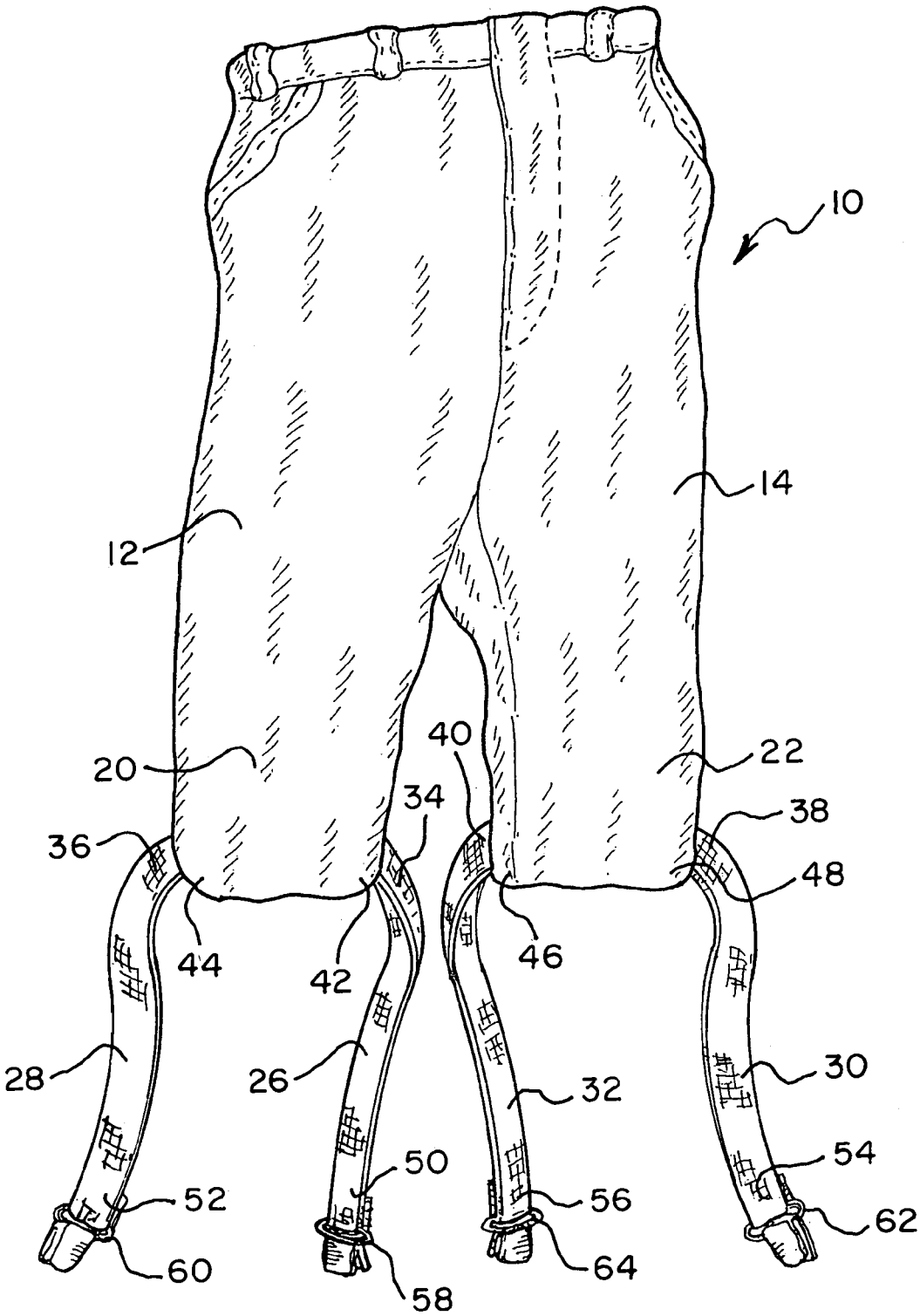
FIG. 1 is a front perspective view of the shorts of the present invention.

Referring now to the drawings in detail wherein like reference numerals have been used throughout the various figures to designate like elements, there is shown in FIG. 1 work pants with built-in knee pads constructed in accordance with the principles of the present invention and designated generally as 10.

Figure 5:
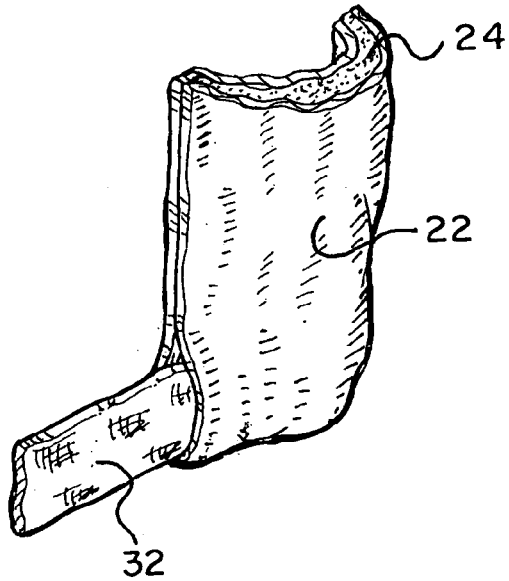
FIG. 5 is view taken through line 5 of FIG. 4.

The work pants of the present invention essentially include a right leg member 12 and a left leg member 14 being in the form of a pair of shorts. (See FIG. 3.) Each of the leg members 12 and 14 has a lower edge 16 and 18, respectively, and a knee section 20 and 22 extending downwardly from the lower edge 16 and 18 of the right and left leg members 12 and 14, respectively. (See FIG. 2.) Padded material 24 is housed within each of the knee sections 20 and 22. (See FIG. 5.) The padded material may be made from a foam material or other similar types of cushioning material typically used in the art.

Figure 3:
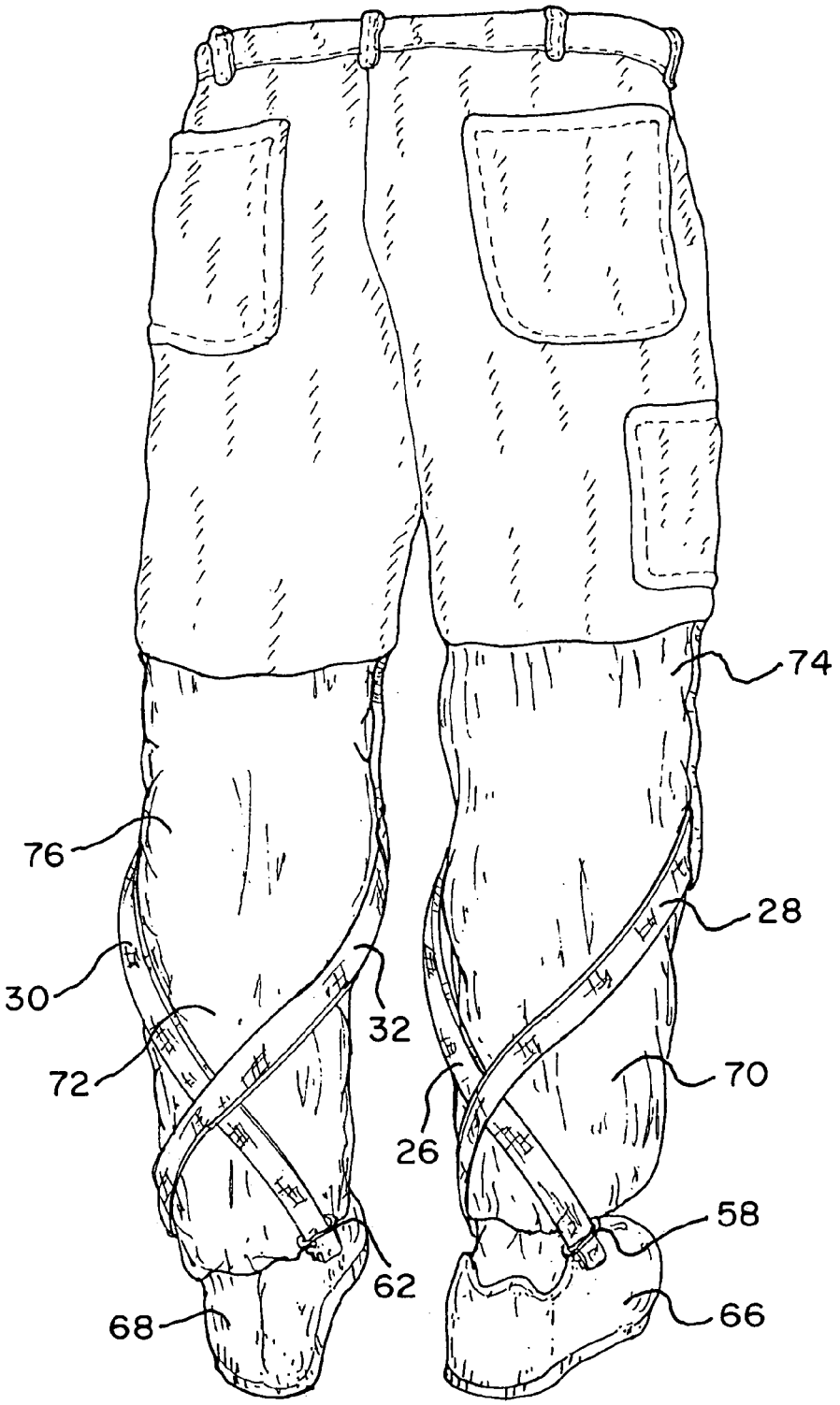
FIG. 3 illustrates the shorts of the present invention being worn by a person.
Figure 4:
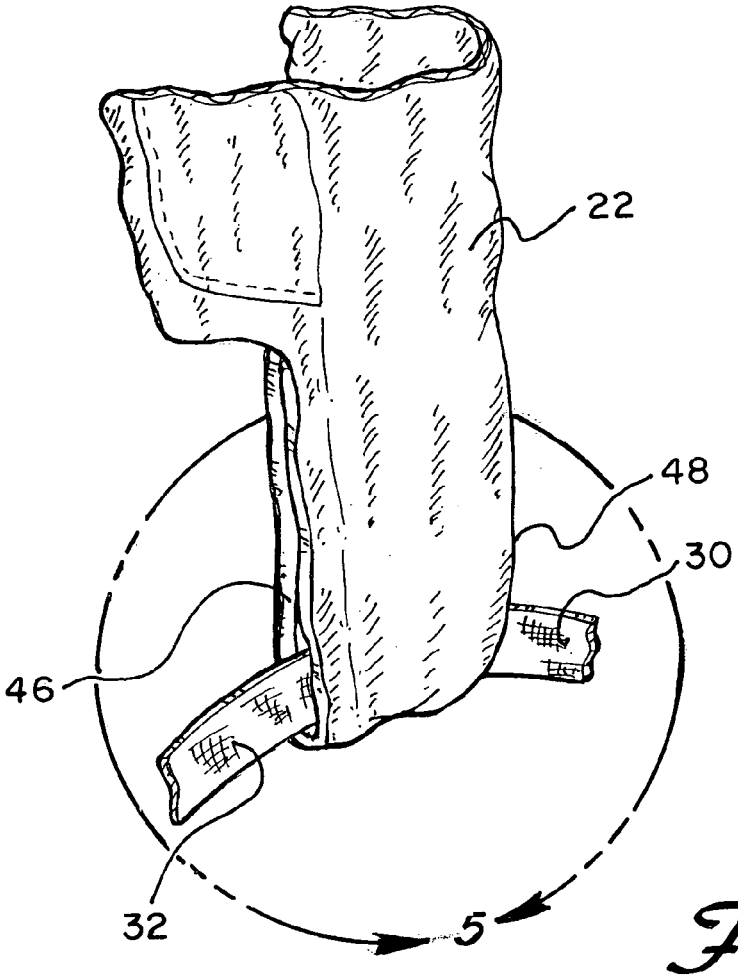
FIG. 4 is a partial view of the work pants of the present invention illustrating the knee pad section of the pants.

Means for releasably securing each of the knee sections 20 and 22 to the person extend downwardly from each knee section. (See FIG. 2.) The securing means may include a plurality of straps 26, 28, 30, and 32 that extend downwardly toward the worker's feet. Each strap 26 and 28 has a top end 34 and 36, respectively. The ends 34 and 26 are secured adjacent the inner side and outer sides 42 and 44 of the right knee section 20, respectively. Likewise, each strap 30 and 32 has a top end 38 and 40, respectively. The ends 38 and 40 are secured to the inner and outer sides 46 and 48 of the left knee section 22, respectively. (See FIGS. 2 and 4.) Straps 26 and 28 also have a lower end 50 and 52, respectively. Straps 30 and 32 also have lower ends 54 and 56. Clips 58 and 60 are attached to lower ends 50 and 52 and clips 62 and 64 are attached to lower ends 54 and 56, respectively. The clips allow the straps to be releasably attached to the worker's shoes 66 and 68 as desired. (See FIG. 3.)

In order to provide a secure fit onto the worker, the straps 26, 28, 30, and 32 may be crisscrossed against the backs 70 and 72 of the worker's legs 74 and 76. (See FIG. 3.) The straps may be made from an elastic material that allows the straps to be easily manipulated and adjusted yet provides sufficient support and stability for holding the knee sections in place as the worker kneels and moves about while working.

Figure 2:
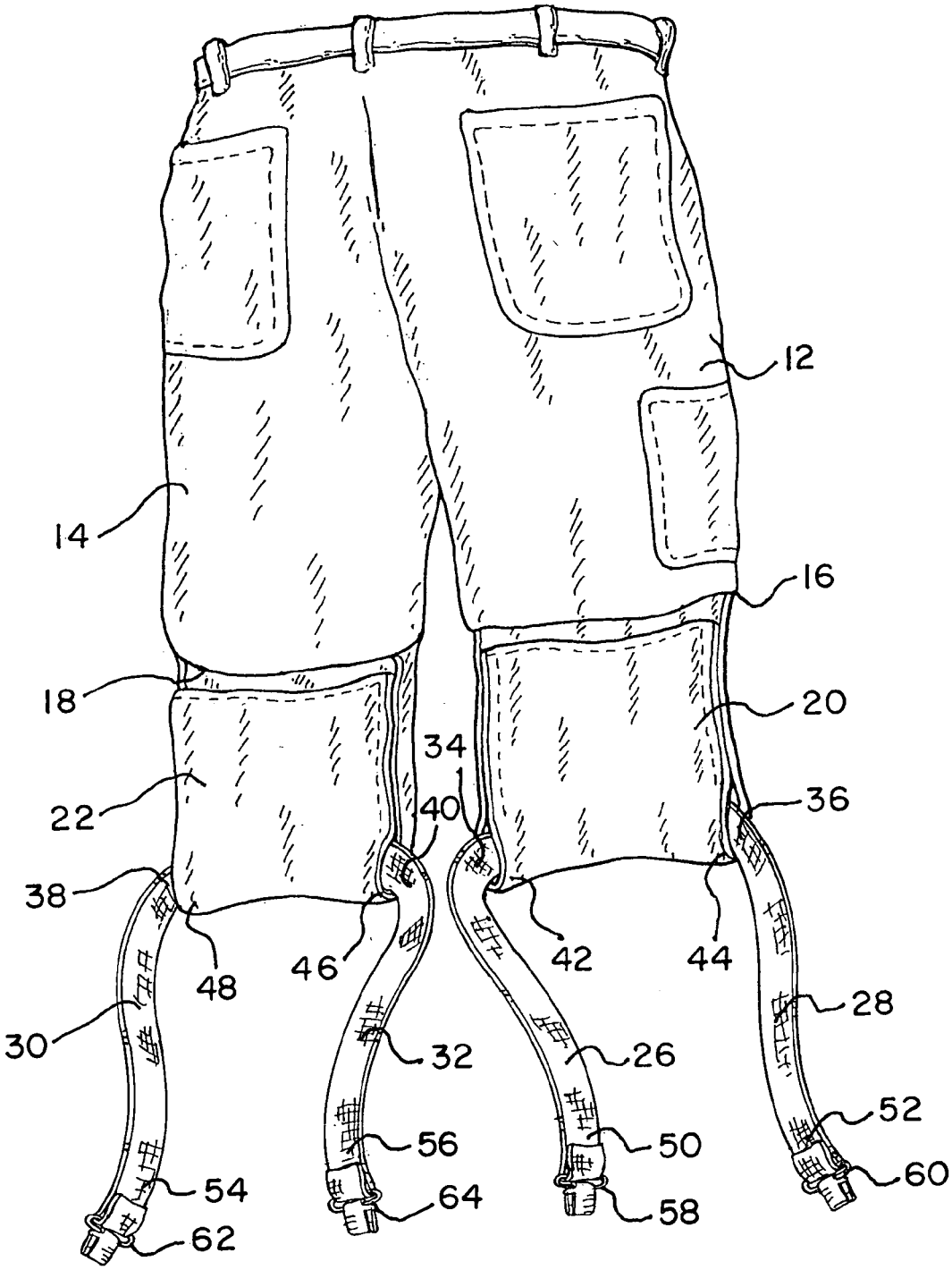
FIG. 2 is a rear perspective view of the shorts of the present invention.

One method of making the work pants of the present invention may be by altering a full length pair of pants. For example, the pair of pants may be cut along each right and left leg side seam from the bottom of the pant leg to approximately the knee. This results in a front flap and a rear flap being formed for each pant leg. The rear flap is then cut away. The front flap is then folded upwardly upon itself and sewn in order to form a pocket or section 20 and 22 at the knee, as shown in FIG. 2. Padding may then be filled into each pocket and straps secured thereto as described above.

The work pants of the present invention may be worn alone as shorts or over a pair of pants. The pants may be made from any type of material typically used in clothing. Furthermore, while the securing means discussed above is the preferred embodiment, it should be realized that other types of securing means known and used in the art may be used as well.

The present invention may be embodied in other specific forms without departing from the spirit or essential attributes thereof and accordingly, reference should be made to the appended claims rather than to the foregoing specification as indicating the scope of the invention.

I claim:

1. A pair of work pants worn by a person comprising:

a right leg member and a left leg member, each of said leg members of the pair of work pants having a lower edge;

a knee section extending downwardly from said lower edge of each of said leg members;

padded material housed within each of said knee sections; and means for releasably securing each of said knee sections to the person, said securing means including a plurality of straps attached solely to said knee sections and extending downwardly towards the person's feet, each of said straps having an end and a clip attached to each of said ends of said straps wherein said clips are adapted to attach to the person's shoes.

2. The pair of work pants worn by a person of claim 1 wherein said work pants are in the form of shorts.

3. The pair of work pants worn by a person of claim 1 wherein said padded material is made from a foam material.

* * * * *